US011763828B2

(12) United States Patent
Hosoya et al.

(10) Patent No.: US 11,763,828 B2
(45) Date of Patent: Sep. 19, 2023

(54) FREQUENCY BAND EXPANSION DEVICE, FREQUENCY BAND EXPANSION METHOD, AND STORAGE MEDIUM STORING FREQUENCY BAND EXPANSION PROGRAM

(71) Applicant: MITSUBISHI ELECTRIC CORPORATION, Tokyo (JP)

(72) Inventors: Kosuke Hosoya, Tokyo (JP); Masaru Kimura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 178 days.

(21) Appl. No.: 17/355,435

(22) Filed: Jun. 23, 2021

(65) Prior Publication Data

US 2021/0319800 A1 Oct. 14, 2021

Related U.S. Application Data

(63) Continuation of application No. PCT/JP2019/003311, filed on Jan. 31, 2019.

(51) Int. Cl.

| | |
|---|---|
| ***G10L 19/00*** | (2013.01) |
| ***G10L 19/02*** | (2013.01) |
| ***G10L 19/028*** | (2013.01) |
| ***G10L 25/18*** | (2013.01) |

(52) U.S. Cl.

CPC ..... *G10L 19/0204* (2013.01); *G10L 19/028* (2013.01); *G10L 25/18* (2013.01)

(58) Field of Classification Search

None

See application file for complete search history.

(56) References Cited

U.S. PATENT DOCUMENTS 3,746,791 A * 7/1973 Wolf ..... G10L 19/08 704/E19.026
3,800,093 A * 3/1974 Wolf ..... H03H 17/02 704/E19.02
2001/0044722 A1* 11/2001 Gustafsson ..... G10L 21/038 704/258

(Continued)

FOREIGN PATENT DOCUMENTS

JP 2002-175092 A 6/2002
JP 3887531 B2 2/2007

(Continued)

*Primary Examiner* — Daniel Abebe

(74) *Attorney, Agent, or Firm* — Birch, Stewart, Kolasch & Birch, LLP

(57) ABSTRACT

A frequency band expansion device includes processing circuitry to calculate a weighting coefficient based on a frequency gradient of the input signal; to generate a white noise signal; to generate a first white noise signal by performing filtering on the white noise signal; to generate a second white noise signal by regulating a phase characteristic of the white noise signal; to generate a third white noise signal by performing weighted addition on the first white noise signal and the second white noise signal by using the weighting coefficient; and to generate the output signal by adding together the input signal and a signal corresponding to the third white noise signal, wherein the processing circuitry is configured so that the phase characteristic of the second white noise signal becomes the same as the phase characteristic of the first white noise signal.

11 Claims, 7 Drawing Sheets

(56) References Cited

U.S. PATENT DOCUMENTS

| | | | | |
|---|---|---|---|---|
| 2003/0093278 | A1* | 5/2003 | Malah | G10L 21/038 704/265 |
| 2009/0024399 | A1* | 1/2009 | Gartner | G10L 19/0208 704/500 |
| 2015/0071446 | A1* | 3/2015 | Sun | H04S 5/00 381/17 |
| 2015/0106084 | A1* | 4/2015 | Atti | G10L 21/0208 704/226 |
| 2015/0317994 | A1* | 11/2015 | Ramadas | G10L 19/24 704/226 |
| 2016/0284361 | A1* | 9/2016 | Yamamoto | G10L 19/26 |
| 2022/0415334 | A1* | 12/2022 | Davidson | G01L 19/04 |

FOREIGN PATENT DOCUMENTS

| | | | |
|---|---|---|---|
| JP | 2009-134260 | A | 6/2009 |
| JP | 4733727 | B2 | 7/2011 |

* cited by examiner

FREQUENCY BAND EXPANSION DEVICE, FREQUENCY BAND EXPANSION METHOD, AND STORAGE MEDIUM STORING FREQUENCY BAND EXPANSION PROGRAM

CROSS-REFERENCE TO RELATED APPLICATION

This application is a continuation application of International Application No. PCT/JP2019/003311 having an international filing date of Jan. 31, 2019.

BACKGROUND OF THE INVENTION

1. Field of the Invention

The present invention relates to a frequency band expansion device, a frequency band expansion method and a frequency band expansion program.

2. Description of the Related Art

In the CD (Compact Disc) standard, for example, the sampling frequency is stipulated as 44.1 [kHz]. In this case, an upper limit bandwidth that can be reproduced is 22.05 [kHz], which is ½ of the sampling frequency. Also in compression coding processing like AAC (Advanced Audio Codec) and MP3 (MPEG Audio Layer 3), the upper limit bandwidth that can be reproduced is limited. In such a circumstance, there has been proposed a method for providing users with sound with higher sound quality by simulatively restoring high-frequency components that have been lost due to digitization.

Patent Reference 1 describes a method of expanding the frequency band by transforming the input signal into a signal in the frequency domain by using Fourier transform, generating the spectrum of the expanded band based on the spectrum of the input signal, and determining the power of the expanded spectrum based on the power of the spectrum of the input signal.

Patent Reference 2 describes a method of expanding the frequency band by transforming the input signal into a signal in the frequency domain by using Fourier transform, determining a reference frequency band to be used for interpolation and an interpolation target frequency band as the target of the interpolation, and extrapolating a spectrum having the same distribution as the spectral distribution of the reference frequency band to the interpolation target frequency band to extend along the envelope.

Patent Reference 1: Japanese Patent Application Publication No. 2009-134260

Patent Reference 2: Japanese Patent Application Publication No. 2002-175092

However, since Fourier transform is used as processing for expanding the frequency band in the methods described in the aforementioned References, there is a problem in that the amount of computation increases and a DSP (Digital Signal Processor) having high computing power becomes necessary.

SUMMARY OF THE INVENTION

An object of the present invention, which has been made to resolve the above-described problem, is to provide a frequency band expansion device capable of expanding the frequency band of an input signal with a small amount of computation and a frequency band expansion method and a frequency band expansion program used for expanding the frequency band of an input signal with a small amount of computation.

A frequency band expansion device according to an aspect of the present invention is a frequency band expansion device that generates an output signal having a bandwidth wider than a bandwidth of an input signal. The device includes processing circuitry to calculate a weighting coefficient based on a frequency gradient of the input signal as a gradient of power of the input signal with respect to a frequency of the input signal; to generate a white noise signal; to generate a first white noise signal by performing filtering on the white noise signal; to generate a second white noise signal by regulating a phase characteristic of the white noise signal; to generate a third white noise signal by performing weighted addition on the first white noise signal and the second white noise signal by using the weighting coefficient; and to generate the output signal by adding together the input signal and a signal corresponding to the third white noise signal, wherein the processing circuitry is configured so that the phase characteristic of the second white noise signal becomes the same as the phase characteristic of the first white noise signal.

A frequency band expansion method according to an aspect of the present invention is a method of generating an output signal having a bandwidth wider than a bandwidth of an input signal. The method includes calculating a weighting coefficient based on a frequency gradient of the input signal as a gradient of power of the input signal with respect to a frequency of the input signal; generating a white noise signal; generating a first white noise signal by performing filtering on the white noise signal; generating a second white noise signal by regulating a phase characteristic of the white noise signal; generating a third white noise signal by performing weighted addition on the first white noise signal and the second white noise signal by using the weighting coefficient; and generating the output signal by adding together the input signal and a signal corresponding to the third white noise signal, wherein the phase characteristic of the second white noise signal is the same as the phase characteristic of the first white noise signal.

According to the present invention, the frequency band of an input signal can be expanded with a small amount of computation.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A frequency band expansion device, a frequency band expansion method and a frequency band expansion program according to each embodiment of the present invention will be described below with reference to the drawings. The following embodiments are just examples and a variety of modifications are possible within the scope of the present invention.

(1) First Embodiment

(1-1) Configuration

Figure 1:
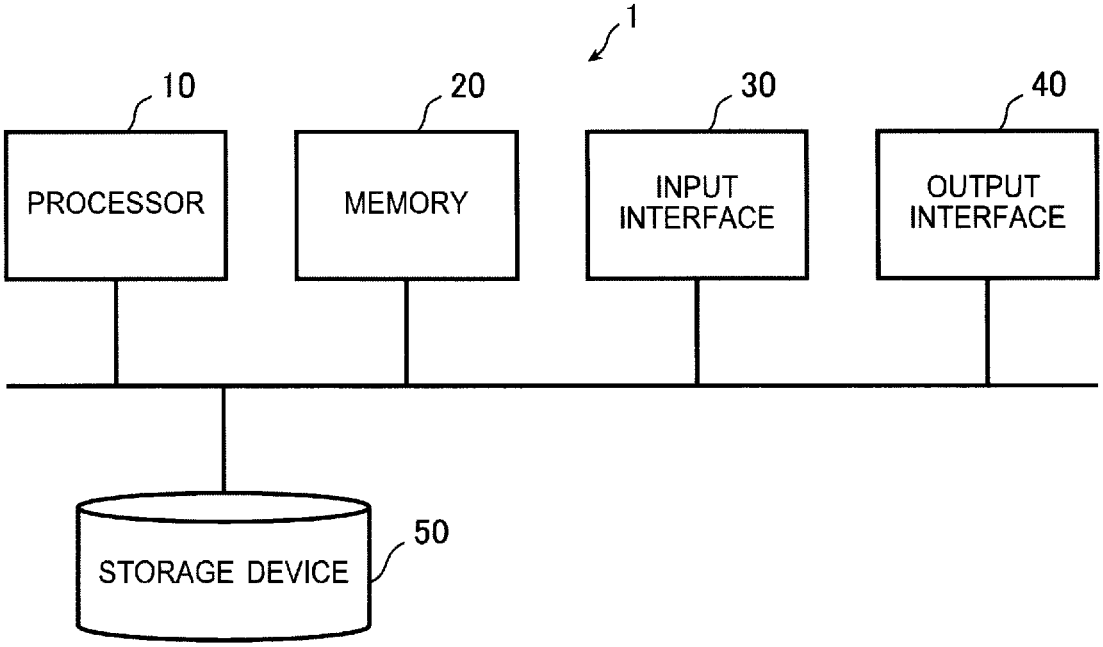
FIG. 1 is a diagram showing an example of a hardware configuration of a frequency band expansion device according to a first embodiment of the present invention.

FIG. 1 is a diagram showing an example of a hardware configuration of a frequency band expansion device 1 according to a first embodiment. In the example shown in FIG. 1, the frequency band expansion device 1 includes, for example, a memory 20 that stores a program as software, namely, a frequency band expansion program, and a processor 10 as an arithmetic processing unit that executes the program stored in the memory 20. The processor 10 is processing circuitry (i.e., an information processing circuit) such as a CPU (Central Processing Unit). The memory 20 is a volatile storage device such as a RAM (Random Access Memory), for example. The frequency band expansion device 1 is a computer, for example.

The frequency band expansion program according to the first embodiment is stored in the memory 20 from a record medium (i.e., a non-transitory computer-readable storage medium) recording information via a medium information reading device (not shown), or via a communication interface (not shown) connectable to the Internet or the like. The frequency band expansion program according to the first embodiment can be executed by the processor 10. A frequency band expansion method according to the first embodiment can be implemented by the processor 10 executing the frequency band expansion program stored in the memory 20.

The frequency band expansion device 1 includes an input interface 30 to which various types of devices such as an input device as a user operation unit like a touch panel, a broadcast wave reception device that receives broadcast signals and a media playback device that plays back various types of audio signal record media are connected. Further, the frequency band expansion device 1 includes an output interface 40 to which a device such as an acoustic signal processing circuit for outputting sound is connected. Furthermore, the frequency band expansion device 1 may include a storage device 50 for storing various types of information such as an HDD (Hard Disk Drive) or an SSD (Solid State Drive). The storage device 50 can be an external storage device of the frequency band expansion device 1. In a case where the frequency band expansion device 1 includes a communication interface (not shown) for communicating with an external device, the storage device 50 can be a storage device existing in the cloud connectable via the communication interface.

Figure 2:
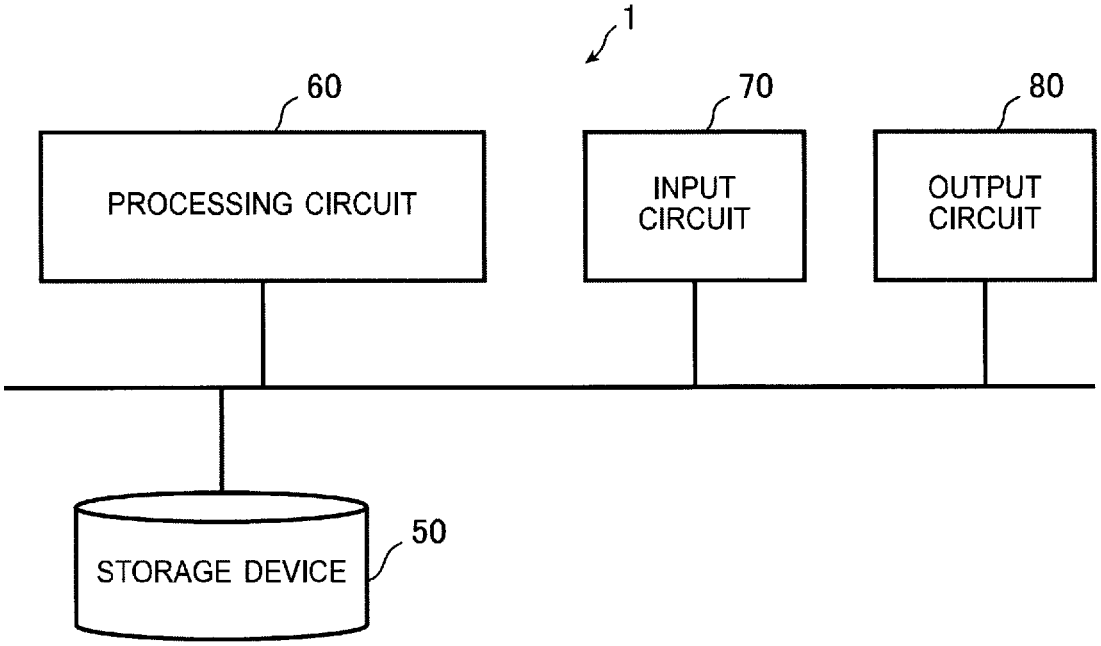
FIG. 2 is a diagram showing another example of the hardware configuration of the frequency band expansion device according to the first embodiment.

FIG. 2 is a diagram showing another example of the hardware configuration of the frequency band expansion device 1 according to the first embodiment. In the example shown in FIG. 2, the frequency band expansion device 1 includes a processing circuit 60 as processing circuitry, an input circuit 70 as an input interface, an output circuit 80 as an output interface, and a storage device (i.e., a storage) 50. The processing circuit 60 is dedicated hardware, for example. The processing circuit 60 may include a processor that implements a function of each circuit by reading in and executing a program stored in a memory. It is also possible to implement a part of the processing circuit 60 by a dedicated circuit and implement another part of the processing circuit 60 by a circuit including a processor that executes software or firmware.

Figure 3:
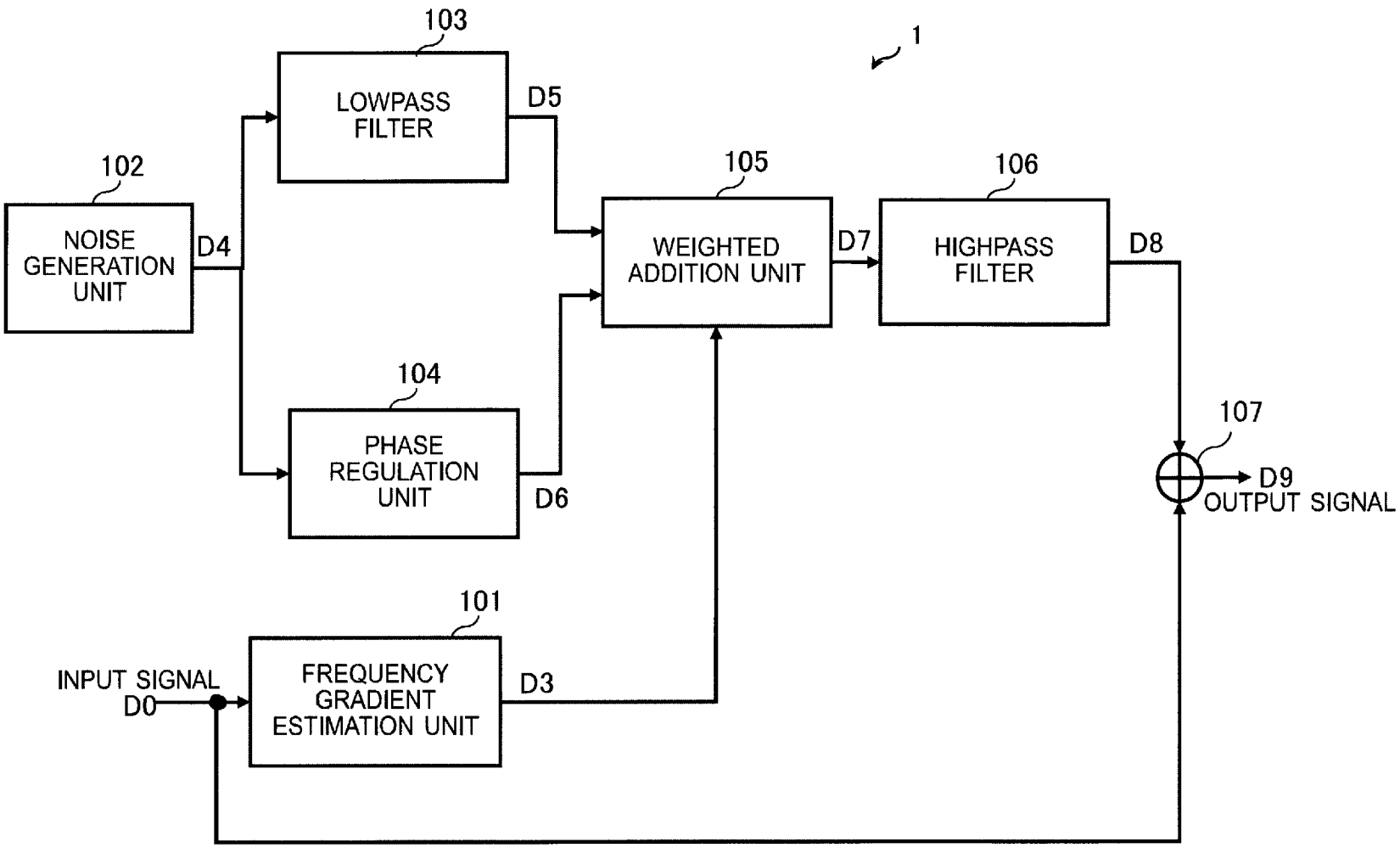
FIG. 3 is a functional block diagram schematically showing a configuration of the frequency band expansion device according to the first embodiment.

FIG. 3 is a functional block diagram schematically showing a configuration of the frequency band expansion device 1 according to the first embodiment. As shown in FIG. 3, the frequency band expansion device 1 includes a frequency gradient estimation unit 101 as a frequency gradient estimator, a noise generation unit 102 as a noise generator, a lowpass filter 103, a phase regulation unit 104 as a phase regulator, a weighted addition unit 105 as a weighted adder, a highpass filter 106 and a signal addition unit 107 as a signal adder. These components can be implemented by the processor 10 shown in FIG. 1 or the processing circuit 60 shown in FIG. 2.

In the first embodiment, the bandwidth of an output signal D9 of the frequency band expansion device 1 is greater than the bandwidth of an input signal D0 of the frequency band expansion device 1. In the first embodiment, a description will be given of a case where the bandwidth of the input signal D0 is 24,000 [Hz] and the bandwidth of the output signal D9 is 48,000 [Hz]. However, the bandwidth of the input signal D0 and the bandwidth of the output signal D9 are not limited to the aforementioned values.

The frequency gradient estimation unit 101 estimates a frequency gradient of the input signal D0 and calculates a weighting coefficient D3 (i.e., a which will be explained later) by using the estimated frequency gradient. The frequency gradient estimation unit 101 is a calculation unit that calculates the weighting coefficient D3.

Figure 4:
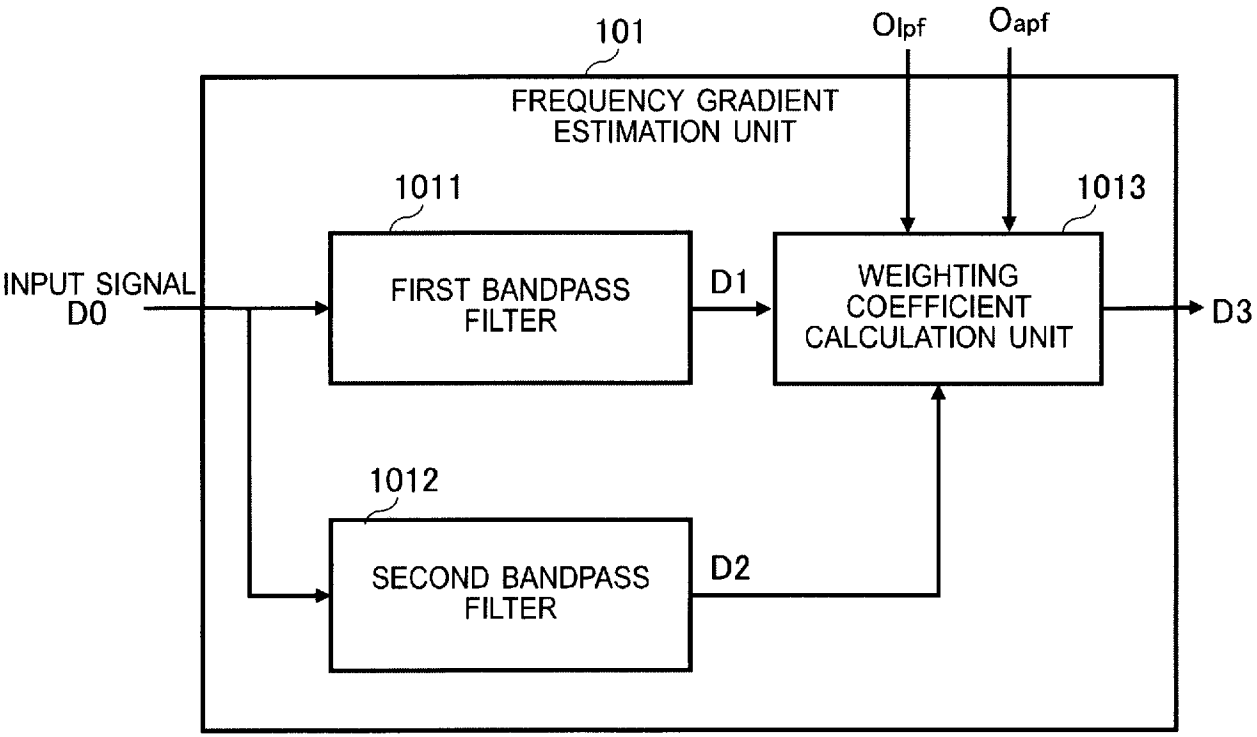
FIG. 4 is a functional block diagram schematically showing a configuration of a frequency gradient estimation unit shown in FIG. 3.

FIG. 4 is a functional block diagram schematically showing a configuration of the frequency gradient estimation unit 101. As shown in FIG. 4, the frequency gradient estimation unit 101 includes a first bandpass filter 1011, a second bandpass filter 1012 and a weighting coefficient calculation unit 1013 as a weighting coefficient calculator.

The first bandpass filter 1011 performs filtering on the input signal D0 and outputs the filtered signal D1. In other words, the first bandpass filter 1011 allows only frequency components in a passband in the input signal D0 to pass through and thereby outputs the signal D1. As the first bandpass filter 1011, an IIR (Infinite Impulse Response) filter or an FIR (Finite Impulse Response) filter whose center frequency is $F_{c1}$ [Hz] can be used. The passband width of the first bandpass filter 1011 is approximately 500 [Hz], for example. However, the passband width of the first bandpass filter 1011 is not limited to the aforementioned value.

The second bandpass filter 1012 performs filtering on the input signal D0 and outputs the filtered signal D2. In other words, the second bandpass filter 1012 allows only frequency components in a passband in the input signal D0 to pass through and thereby outputs the signal D2. As the second bandpass filter 1012, an IIR filter or an FIR filter whose center frequency is $F_{c2}$ [Hz] can be used. The center frequency $F_{c2}$ [Hz] of the second bandpass filter 1012 is desired to be twice the center frequency $F_{c1}$ [Hz] of the first bandpass filter 1011. For example, when $F_{c1}$=10,000 [Hz], $F_{c2}$ is desired to be 20,000 [Hz]. Further, the passband width of the second bandpass filter 1012 is equal to the passband width of the first bandpass filter 1011.

The weighting coefficient calculation unit 1013 estimates the frequency gradient based on the power (i.e., a value corresponding to the amplitude) of the signal D1 that has passed through the first bandpass filter 1011 and the power of the signal D2 that has passed through the second bandpass filter 1012, and calculates the weighting coefficient D3 by using the frequency gradient. In other words, the weighting coefficient calculation unit 1013 estimates the frequency gradient of the input signal D0, as the gradient of the power of the input signal D0 with respect to the frequency of the input signal D0, based on the power of the signal D1 at the frequency $F_{c1}$ [Hz] in the input signal D0 and the power of the signal D2 at the frequency $F_{c2}$ [Hz]=$2_{c1}$ [Hz] in the input signal D0, and calculates the weighting coefficient D3 by using the frequency gradient.

The weighting coefficient calculation unit 1013 calculates mean-square power of the power of L samples in an interval from a present sample to a sample at a time point L samples earlier than the present sample, by using the signal D1 that has passed through the first bandpass filter 1011. L is a predetermined positive integer. For the calculation, the weighting coefficient calculation unit 1013 buffers the signal D1 that has passed through the first bandpass filter 1011 for a small number of samples. The small number of samples mean, for example, samples in a period within 5 ms. Therefore, the buffer size in the first embodiment is extremely small compared to the buffer size necessary for Fourier transform.

Subsequently, the weighting coefficient calculation unit 1013 calculates the mean-square power of the power of L samples in an interval from a present sample to a sample at a time point L samples earlier than the present sample, by using the signal D2 that has passed through the second bandpass filter 1012. For this calculation, the weighting coefficient calculation unit 1013 performs the buffering for the same buffer size as in the case of the first bandpass filter 1011.

Subsequently, the weighting coefficient calculation unit 1013 calculates the weighting coefficient α (or D3) according to the following expressions (1) and (2) by using the mean-square power of the signal D1 that has passed through the first bandpass filter 1011 and the mean-square power of the signal D2 that has passed through the second bandpass filter 1012:

$$O_{in} = 10\log_{10}\frac{P_{bpf2}}{P_{bpf1}} \tag{1}$$

$$\alpha = \begin{cases} 0.0 & (O_{in} > O_{apf}) \\ \dfrac{O_{apf} - O_{in}}{O_{apf} - O_{lpf}} & (O_{lpf} < O_{in} < O_{apf}) \\ 1.0 & (O_{in} < O_{lpf}) \end{cases} \tag{2}$$

Here, $O_{in}$ represents the frequency gradient of the input signal D0, $P_{bpf1}$ represents the mean-square power of the signal D1 that has passed through the first bandpass filter 1011, and $P_{bpf2}$ represents the mean-square power of the signal D2 that has passed through the second bandpass filter 1012. Further, $O_{apf}$ represents the frequency gradient of a white noise signal D6 after undergoing phase regulation by the phase regulation unit 104 which will be described later, and $O_{lpf}$ represents the frequency gradient of a white noise signal D5 after passing through the lowpass filter 103 which will be described later. The weighting coefficient calculation unit 1013 has previously held the frequency gradients $O_{apf}$ and $O_{lpf}$.

Incidentally, while the mean-square power is used as $P_{bpf1}$ and $P_{bpf2}$ in the expressions (1) and (2), it is also possible to use RMS (Root Mean Square), average amplitude or the like instead of the mean-square power.

In the following, the description will be given with reference to FIG. 3. The noise generation unit 102 generates a white noise signal D4 that is a signal simulating white noise.

The lowpass filter 103 allows the white noise signal D4 outputted from the noise generation unit 102 to pass through, thereby attenuating high-frequency components of the signal and outputting the white noise signal D5. The white noise signal D5 is referred to also as a first white noise signal. In this case, the cutoff frequency used by the lowpass filter 103 is 24,000 [Hz] and the frequency gradient of the white noise signal D5 that has passed through the lowpass filter 103 is $O_{lpf}$. The value $O_{lpf}$ is a previously set value. For example, a frequency gradient $O_{lpf}$ of −24 [dB/Oct] can be implemented by using a fourth order IIR filter. Incidentally, it is also possible to reproduce the same frequency characteristic by using a different means such as an FIR filter.

The phase regulation unit 104 regulates a phase characteristic of the white noise signal D4 outputted from the noise generation unit 102 and outputs the white noise signal D6 after undergoing the phase characteristic regulation. The white noise signal D6 is referred to also as a second white noise signal. The frequency gradient of the white noise signal D6 that has passed through the phase regulation unit 104 is $O_{apf}$. The value $O_{apf}$ is a previously set value. The phase regulation unit 104 is desired to regulate only the phase characteristic of the white noise signal D4 without changing the other characteristics of the white noise signal D4. This phase regulation is performed so that the phase characteristic of the white noise signal D6 after undergoing the phase characteristic regulation becomes the same as the phase characteristic of the white noise signal D5 that has passed through the lowpass filter 103. Let M represent a positive integer, it is known that the phase characteristic of a 2M-th order lowpass IIR filter and the phase characteristic of an M-th order APF (All Pass Filter) are the same as each other. For example, in a case where the lowpass filter 103 is famed with a fourth order IIR filter, the phase characteristic of the lowpass filter 103 and the phase characteristic of the phase regulation unit 104 can be made the same as each other by previously forming the phase regulation unit 104 with a second order APF.

Incidentally, in a case where the lowpass filter 103 is formed with an FIR filter, the phase characteristic has a linear phase characteristic, and thus the phase regulation unit 104 is capable of generating the white noise signal D6 having the same phase characteristic as the white noise signal D5 by delaying the white noise signal D4 by an appropriate number of samples equal to ½ of the number of taps of the FIR filter.

The weighted addition unit 105 generates a white noise signal D7 obtained by weighted addition by using the weighting coefficient D3 (i.e., α) outputted from the frequency gradient estimation unit 101, the white noise signal D5 that has passed through the lowpass filter 103, and the white noise signal D6 after undergoing the phase regulation by the phase regulation unit 104. The white noise signal D7 is referred to also as a third white noise signal. In this case, the process executed by the weighted addition unit 105 is represented by the following expression (3), for example:

$$S'(t) = \alpha \cdot S_{lpf}(t) + (1 - \alpha) \cdot S_{apf}(t) \quad (3)$$

In the expression (3), $S_{lpf}(t)$ represents the white noise signal D5 that has passed through the lowpass filter 103, $S_{apf}(t)$ represents the white noise signal D6 that has passed through the phase regulation unit 104, and S'(t) represents the white noise signal D7 obtained by the weighted addition. Further, t is an integer representing a time index.

According to the expression (2) and the expression (3), when the frequency gradient $O_{in}$ of the input signal D0 is greater than the frequency gradient $O_{apf}$ of the white noise signal D6 that has passed through the phase regulation unit 104, $\alpha=0$ holds, and thus S'(t) as the amplitude of the white noise signal D7 obtained by the weighted addition is equal to $S_{apf}(t)$ as the amplitude of the white noise signal D6 that has passed through the phase regulation unit 104. In this case, the output signal D9 having a wide bandwidth is generated by using the white noise signal D7 whose phase characteristic alone has been regulated and whose amplitude has not been changed compared to the white noise signal D4.

Further, according to the expression (2) and the expression (3), when the frequency gradient $O_{in}$ of the input signal D0 is less than the frequency gradient $O_{lpf}$ of the white noise signal D5 that has passed through the lowpass filter 103, $\alpha=1$ holds, and thus S'(t) as the amplitude of the white noise signal D7 obtained by the weighted addition is equal to $S_{lpf}(t)$ as the amplitude of the white noise signal D5 that has passed through the lowpass filter 103. In this case, the output signal D9 having a wide bandwidth is generated by using the white noise signal D7 whose amplitude has been attenuated compared to the white noise signal D4.

Furthermore, according to the expression (2) and the expression (3), when the frequency gradient $O_{in}$ of the input signal D0 is within a range from the frequency gradient $O_{lpf}$ of the white noise signal D5 that has passed through the lowpass filter 103 to the frequency gradient $O_{apf}$ of the white noise signal D6 that has passed through the phase regulation unit 104, $0<\alpha<1$ holds. In this case, $\alpha$ is a value according to a ratio between a frequency gradient difference ($O_{apf}-O_{lpf}$) and a frequency gradient difference ($O_{apf}-O_{in}$). Specifically, a approaches 0 with the increase in the frequency gradient $O_{in}$ of the input signal D0 and approaches 1 with the decrease in the frequency gradient $O_{in}$ of the input signal D0.

In other words, when the frequency gradient Om of the input signal D0 is small and a is close to 1, the output signal D9 having a wide bandwidth is generated by adding a white noise signal close to the white noise signal D5 that has passed through the lowpass filter 103 to the input signal D0. In contrast, when the frequency gradient $O_{in}$ of the input signal D0 is large and a is close to 0, the output signal D9 having a wide bandwidth is generated by adding a white noise signal close to the white noise signal D6 that has passed through the phase regulation unit 104 to the input signal D0.

The highpass filter 106 performs filtering on the white noise signal D7 obtained by the weighted addition and outputs the filtered white noise signal D8. The white noise signal D8 is referred to also as a fourth white noise signal. In other words, the highpass filter 106 allows only frequency components in a passband in the white noise signal D7 to pass through and thereby outputs the white noise signal D8. In this case, as the highpass filter 106, an FIR filter whose cutoff frequency is 24,000 [Hz] is used, for example. Incidentally, it is also possible to employ a different filter as the highpass filter 106. For example, an IIR filter having a cutoff frequency of 24,000 [Hz] may also be used as the highpass filter 106. Incidentally, the cutoff frequency of the highpass filter 106 is not limited to the aforementioned value.

The signal addition unit 107 generates the output signal D9 by adding together the input signal D0 and the white noise signal D8 that has passed through the highpass filter 106. It is also possible for the signal addition unit 107 to generate the output signal D9 by adding a signal corresponding to the white noise signal D7, e.g., the white noise signal D7 itself, to the input signal D0.

(1-2) Operation

Figure 5:
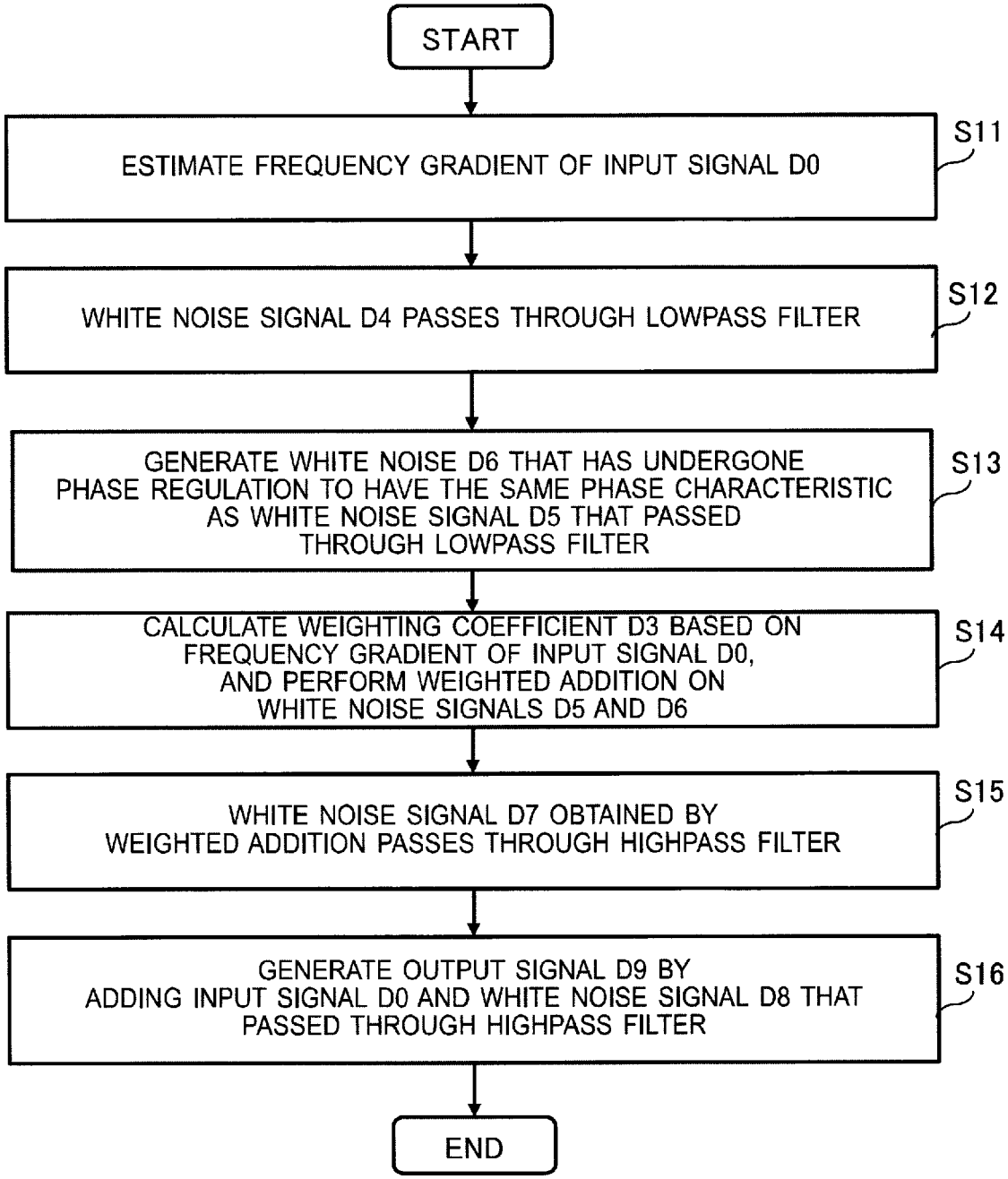
FIG. 5 is a flowchart showing an operation of the frequency band expansion device according to the first embodiment.

FIG. 5 is a flowchart showing an operation of the frequency band expansion device 1 according to the first embodiment. In step S11, the frequency gradient estimation unit 101 estimates the frequency gradient of the input signal D0 based on the input signal D0.

In the next step S12, the lowpass filter 103 allows the white noise signal D4 outputted from the noise generation unit 102 to pass through and thereby outputs the white noise signal D5.

In the next step S13, the phase regulation unit 104 allows the white noise signal D4 outputted from the noise generation unit 102 to pass through and thereby outputs the white noise signal D6. The phase regulation unit 104 has been set so that the phase characteristic of the white noise signal D6 becomes the same as the phase characteristic of the white noise signal D5.

In the next step S14, the frequency gradient estimation unit 101 calculates the weighting coefficient from the frequency gradient of the input signal D0, and the weighted addition unit 105 performs the weighted addition on the white noise signals D5 and D6.

In the next step S15, the highpass filter 106 allows the white noise signal D7 obtained by the weighted addition to pass through and thereby outputs the white noise signal D8.

In the next step S16, the signal addition unit 107 generates the output signal D9 by adding together the input signal D0 and the white noise signal D8 that has passed through the highpass filter 106.

(1-3) Effect

As described above, with the frequency band expansion device 1, the frequency band expansion method or the frequency band expansion program according to the first embodiment, the frequency band can be expanded appropriately by estimating the frequency gradient of the input signal D0 based on the signal D1 that has passed through the first bandpass filter 1011 and the signal D2 that has passed through the second bandpass filter 1012, generating a white noise signal with a desired frequency gradient by using the weighting coefficient $\alpha$ calculated based on the estimated frequency gradient, and adding the generated white noise signal to the input signal D0.

Further, in the first embodiment, implementation on a low-priced DSP is easy since no Fourier transform is used, and immediately responding to even abrupt time jitter of the input signal is possible since the buffer size is also extremely small.

(2) Second Embodiment

Figure 6:
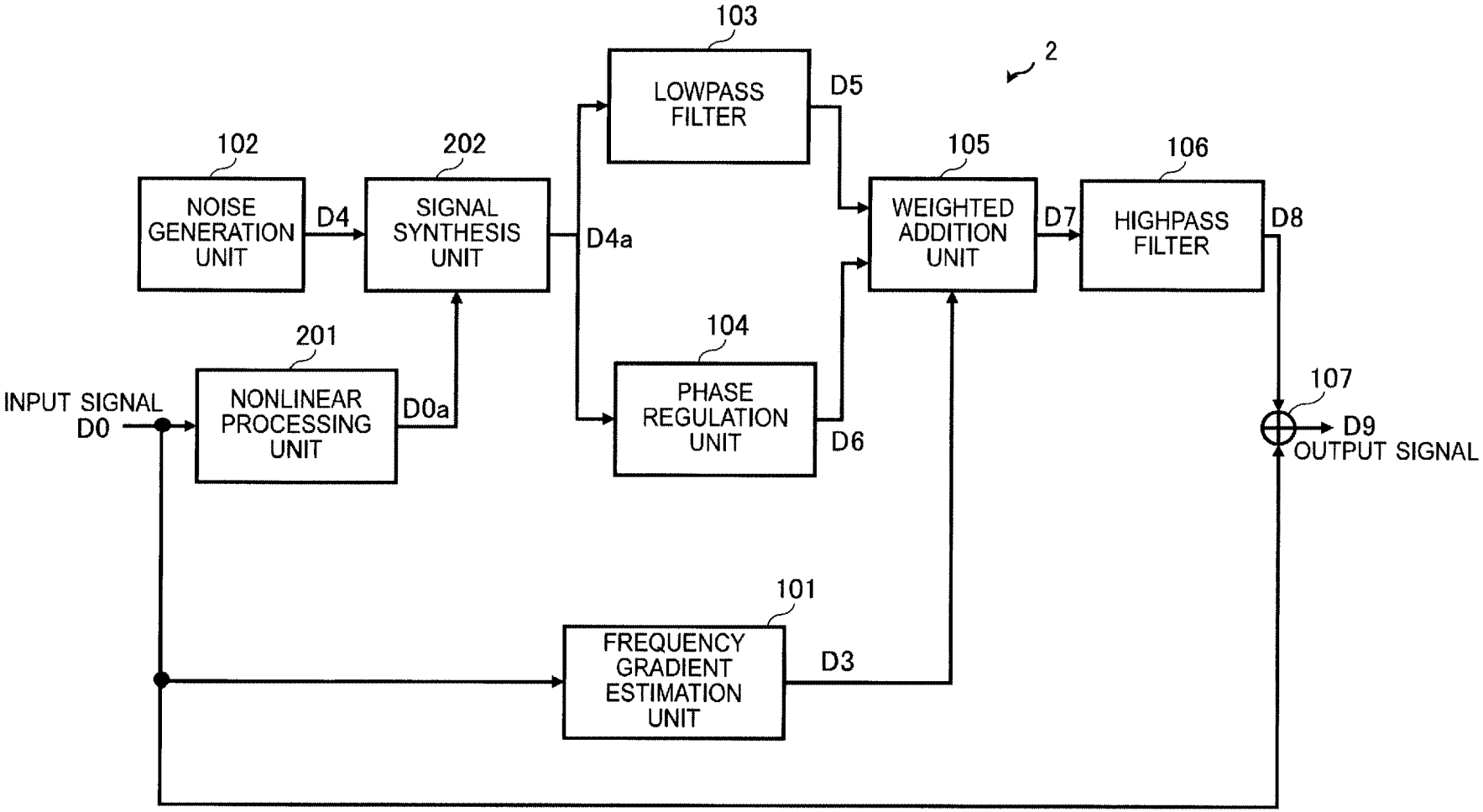
FIG. 6 is a functional block diagram schematically showing a configuration of a frequency band expansion device according to a second embodiment of the present invention.

FIG. 6 is a functional block diagram schematically showing a configuration of a frequency band expansion device 2 according to a second embodiment. In FIG. 6, each component identical or corresponding to a component shown in FIG. 3 is assigned the same reference character as in FIG. 3. The frequency band expansion device 2 according to the second embodiment differs from the frequency band expansion device 1 according to the first embodiment in including a nonlinear processing unit 201 as a nonlinear processor and a signal synthesis unit 202 as a signal synthesizer. Except for these features, the frequency band expansion device 2 according to the second embodiment is the same as the frequency band expansion device 1 according to the first embodiment.

The nonlinear processing unit 201 performs nonlinear processing on the input signal D0 and thereby outputs a signal D0*a* after undergoing the nonlinear processing that includes harmonic components of the input signal D0. The nonlinear processing performed by the nonlinear processing unit 201 is full-wave rectification processing, half-wave rectification processing or the like, for example. However, it is also possible to employ processing other than the full-wave rectification processing or the half-wave rectification processing as the nonlinear processing performed by the nonlinear processing unit 201.

The signal synthesis unit 202 adds the signal D0*a* outputted from the nonlinear processing unit 201 and the white noise signal D4 together and thereby outputs a white noise signal D4*a* to the lowpass filter 103 and the phase regulation unit 104. The white noise signal D4*a* is referred to also as a synthetic white noise signal. Subsequent processes are the same as corresponding processes in the first embodiment.

As described above, with the frequency band expansion device 2, the frequency band expansion method or the frequency band expansion program according to the second embodiment, the spectrum of the expanded frequency band can be generated with high accuracy in a case where the input signal D0 is a signal indicating sound emitted from a sound source having harmonic components such as a violin.

(3) Third Embodiment

Figure 7:
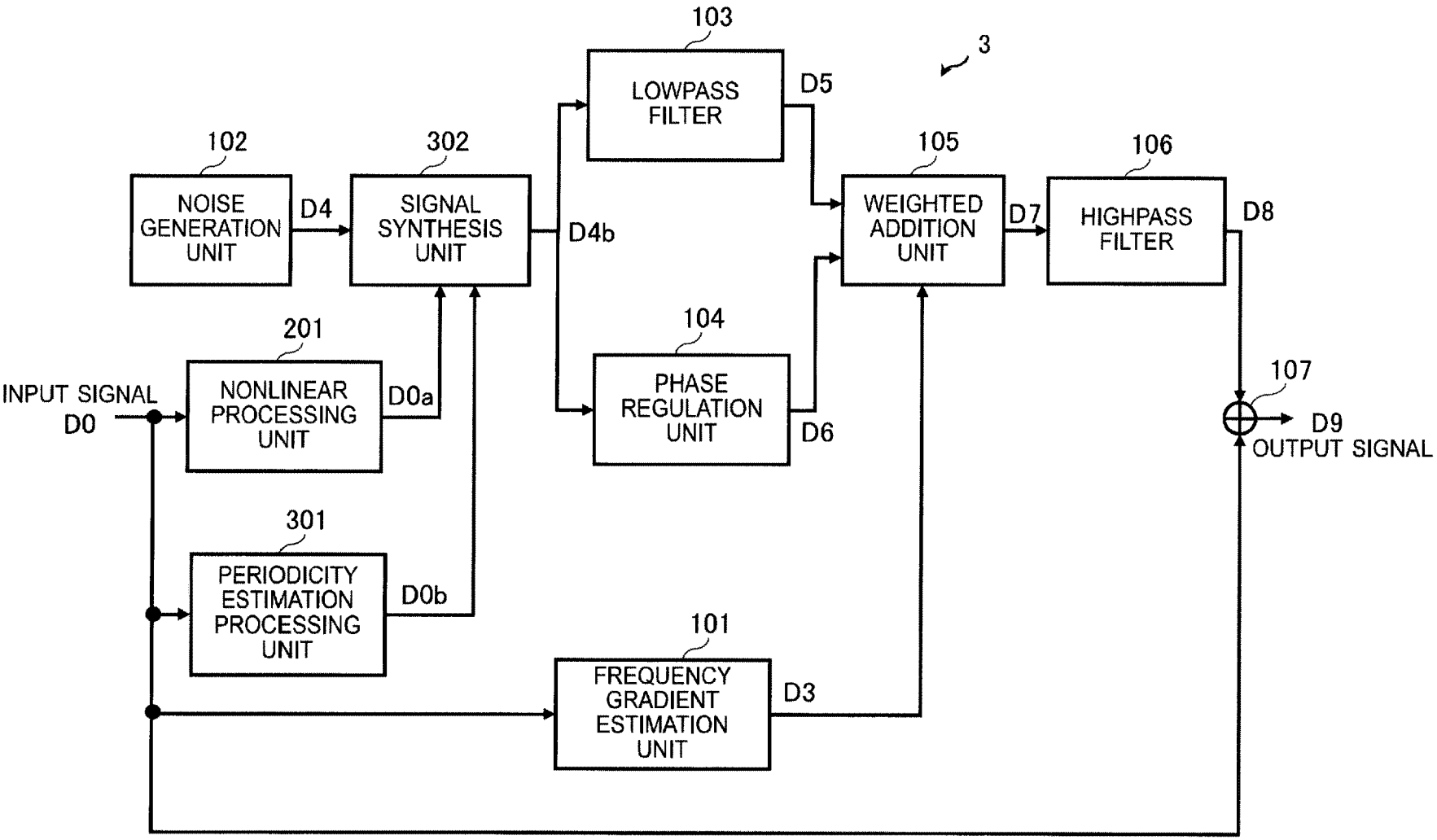
FIG. 7 is a functional block diagram schematically showing a configuration of a frequency band expansion device according to a third embodiment of the present invention.

FIG. 7 is a functional block diagram schematically showing a configuration of a frequency band expansion device 3 according to a third embodiment. In FIG. 7, each component identical or corresponding to a component shown in FIG. 6 is assigned the same reference character as in FIG. 6. The frequency band expansion device 3 according to the third embodiment differs from the frequency band expansion device 2 according to the second embodiment in including a periodicity estimation processing unit 301 as a periodicity estimation processor in the contents of a process executed by a signal synthesis unit 302 as a signal synthesizer. Except for these features, the frequency band expansion device 3 according to the third embodiment is the same as the frequency band expansion device 2 according to the second embodiment.

The periodicity estimation processing unit 301 outputs a signal D0*b* by performing autocorrelation analysis on the input signal D0. In other words, by adding the periodicity estimation processing unit 301, a frequency envelope of the expanded band can be generated with higher accuracy. The process executed by the periodicity estimation processing unit 301 is represented by the following expression (4), for example:

$$cor_{max} = \max_{\tau} \frac{\frac{1}{N}\sum_{i=1}^{N} x(t-i) * x(t-\tau-i)}{\sqrt{\frac{1}{N}\sum_{i=1}^{N} x^2(t-i)}\sqrt{\frac{1}{N}\sum_{i=1}^{N} x^2(t-\tau-i)}} \quad (4)$$

In the expression (4), x(t) represents the value of the input signal D0 at the time index t, and τ is an integer representing the number of samples of the delaying. Further, N is an integer representing the buffer size of an analysis interval, and $cor_{max}$ represents a maximum normalized autocorrelation value as the signal D0*b* outputted from the periodicity estimation processing unit 301.

As indicated by the expression (4), the periodicity estimation processing unit 301 calculates the maximum normalized autocorrelation value $cor_{max}$ indicating to what extent the input signal D0 is periodical, and outputs the maximum normalized autocorrelation value $cor_{max}$ to the signal synthesis unit 302 as the signal D0*b*.

The signal synthesis unit 302 performs a synthesis process on the white noise signal D4 and the signal D0*a* after undergoing the nonlinear processing by the nonlinear processing unit 201 based on the maximum normalized autocorrelation value $cor_{max}$, and outputs a white noise signal D4*b* obtained by the synthesis process to the lowpass filter 103 and the phase regulation unit 104. The white noise signal D4*b* is referred to also as a synthetic white noise signal. In this case, the signal synthesis unit 302 may also be configured to output the signal D0*a* from the nonlinear processing unit 201 as the white noise signal D4*b* if the maximum normalized autocorrelation value $cor_{max}$ is greater than or equal to a predetermined threshold value and output the white noise signal D4 as the white noise signal D4*b* if the maximum normalized autocorrelation value is less than the threshold value. Further, the signal synthesis unit 302 may also be configured to perform the weighted addition on the white noise signal D4 and the input signal from the nonlinear processing unit 201 obtained by processing the signal D0 based on the calculated maximum normalized autocorrelation value $cor_{max}$. Namely, the signal synthesis unit 302 may perform the weighted addition by increasing the weight of the signal D0*a* outputted from the nonlinear processing unit 201 and decreasing the weight of the white noise signal D4 with the increase in the calculated maximum normalized autocorrelation value $cor_{max}$.

As described above, with the frequency band expansion device 3, the frequency band expansion method or the frequency band expansion program according to the third embodiment, in a case where the input signal D0 is a signal indicating sound emitted from a sound source having harmonic components such as a violin, the spectrum of the expanded frequency band can be generated with high accuracy and the spectrum of the band can be generated adaptively according to the normalized autocorrelation value.

(4) Modification

Figure 8:
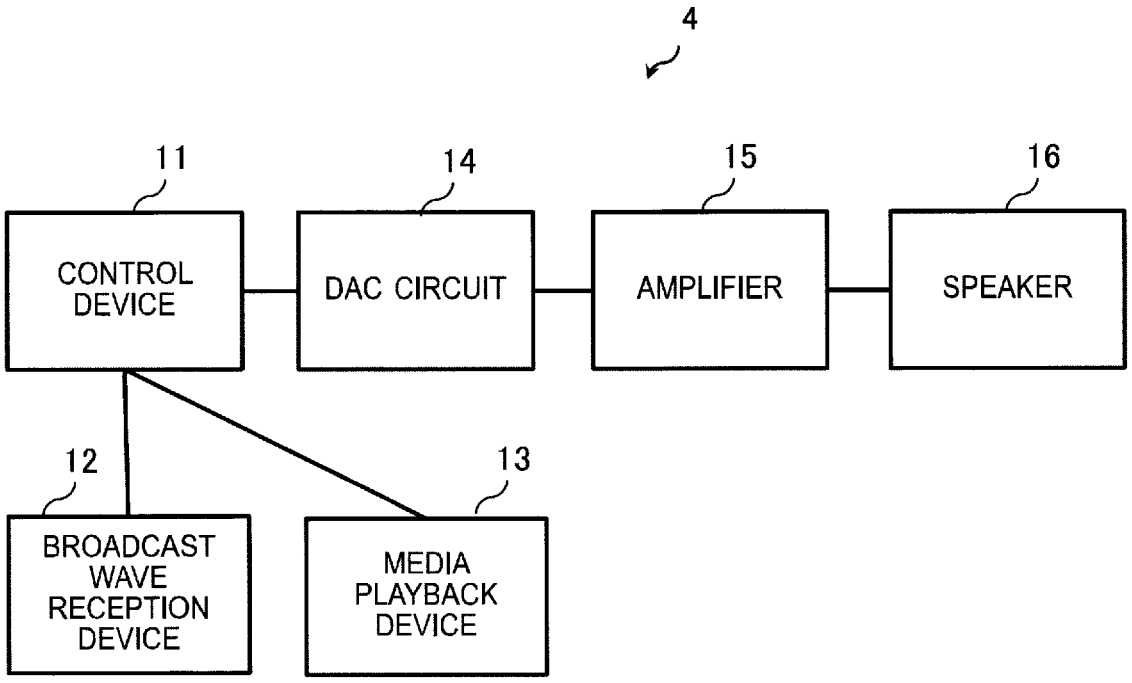
FIG. 8 is a diagram showing an example of a hardware configuration of an audio device including the frequency band expansion device according to any one of the first to third embodiments.

FIG. 8 is a diagram showing an example of a hardware configuration of an audio device 4 including the frequency band expansion device according to any one of the first to third embodiments. The audio device 4 shown in FIG. 8 includes a control device 11 as a control circuit, a broadcast wave reception device 12, a media playback device 13, a DAC (Digital to Analog Converter) circuit 14, an amplifier 15 and a speaker 16.

The control device 11 can include the frequency band expansion device according to any one of the first to third embodiments. The broadcast wave reception device 12 provides the control device 11 with an audio signal based on a broadcast wave. The media playback device 13 is a playback device that plays back audio data recorded in an optical information record medium such as a CD, a DVD or a Blu-ray Disc (registered trademark), for example. The audio device may include a communication device for receiving an audio signal from the Internet instead of including the broadcast wave reception device 12 and the media playback device 13.

A stereo signal outputted from the media playback device 13 or the broadcast wave reception device 12 is converted to an analog signal by the DAC circuit 14 and this analog signal is supplied to the speaker 16 via the amplifier 15.

The audio device 4 is capable of outputting sound with higher sound quality since the control device 11 includes the frequency band expansion device according to any one of the first to third embodiments.

DESCRIPTION OF REFERENCE CHARACTERS

1, 2, 3: frequency band expansion device, 4: audio device, 101: frequency gradient estimation unit, 102: noise generation unit, 103: lowpass filter, 104: phase regulation unit, 105: weighted addition unit, 106: highpass filter, 107: signal addition unit, 1011: first bandpass filter, 1012: second bandpass filter, 1013: weighting coefficient calculation unit, 201: nonlinear processing unit, 202, 302: signal synthesis unit, 301: periodicity estimation processing unit, D0: input signal, D4: white noise signal, D9: output signal.

What is claimed is:

1. A frequency band expansion device that generates an output signal having a bandwidth wider than a bandwidth of an input signal, the frequency band expansion device comprising:

processing circuitry to calculate a weighting coefficient based on a frequency gradient of the input signal as a gradient of power of the input signal with respect to a frequency of the input signal;

to generate a white noise signal;

to generate a first white noise signal by performing filtering on the white noise signal;

to generate a second white noise signal by regulating a phase characteristic of the white noise signal;

to generate a third white noise signal by performing weighted addition on the first white noise signal and the second white noise signal by using the weighting coefficient;

to generate the output signal in a procedure by adding together the input signal and a signal corresponding to the third white noise signal, and to transmit the output signal to an amplifier and a speaker that are operably connected together, wherein the processing circuitry is configured so that the phase characteristic of the second white noise signal becomes the same as the phase characteristic of the first white noise signal, wherein the procedure generates the output signal having the wider bandwidth than the bandwidth of the input signal without using a Fourier transform, thereby reducing an amount of computing power required to generate the output signal, and wherein the processing circuitry facilitates control of an output of sound from the speaker on a basis of the generated output signal.

2. The frequency band expansion device according to claim 1, wherein the processing circuitry generates a fourth white noise signal by attenuating low-frequency components of the third white noise signal, and generates the output signal by adding the input signal and the fourth white noise signal together.

3. The frequency band expansion device according to claim 1, wherein the processing circuitry generates the third white noise signal by increasing the weighting of the first white noise signal that has passed through a lowpass filter that generates the first white noise signal and decreasing the weighting of the second white noise signal that has passed through the phase regulator that generates the second white noise signal with a decrease in the frequency gradient of the input signal, and generates the third white noise signal by decreasing the weighting of the first white noise signal that has passed through the lowpass filter and increasing the weighting of the second white noise signal that has passed through the phase regulator with an increase in the frequency gradient of the input signal.

4. The frequency band expansion device according to claim 1, wherein when the frequency gradient of the input signal is within a range from the frequency gradient of the first white noise signal to the frequency gradient of the second white noise signal, the processing circuitry generates the third white noise signal by increasing the weighting of the first white noise signal that has passed through a lowpass filter that generates the first white noise signal and decreasing the weighting of the second white noise signal that has passed through the phase regulator that generates the second white noise signal with a decrease in the frequency gradient of the input signal, and generates the third white noise signal by decreasing the weighting of the first white noise signal that has passed through the lowpass filter and increasing the weighting of the second white noise signal that has passed through the phase regulator with an increase in the frequency gradient of the input signal.

5. The frequency band expansion device according to claim 4, wherein when the frequency gradient of the input signal is less than the frequency gradient of the first white noise signal, the processing circuitry uses the first white noise signal that has passed through the lowpass filter as the third white noise signal.

6. The frequency band expansion device according to claim 4, wherein when the frequency gradient of the input signal is greater than the frequency gradient of the second white noise signal, the processing circuitry uses the second white noise signal that has passed through the phase regulator as the third white noise signal.

7. The frequency band expansion device according to claim 1, wherein the processing circuitry includes:

a first bandpass filter that allows the input signal to pass through; and a second bandpass filter that has a center frequency different from a center frequency of the first bandpass filter and allows the input signal to pass through, and calculates the frequency gradient of the input signal based on power of a signal that has passed through the first bandpass filter and power of a signal that has passed through the second bandpass filter.

8. The frequency band expansion device according to claim 1, wherein the processing circuitry performs nonlinear processing on the input signal and thereby outputs a signal after undergoing the nonlinear processing; and generates a synthetic white noise signal by combining the white noise signal and the signal after undergoing the nonlinear processing together, generates the first white noise signal from the synthetic white noise signal, and generates the second white noise signal from the synthetic white noise signal.

9. The frequency band expansion device according to claim 8, wherein the processing circuitry calculates a maximum normalized autocorrelation value by estimating periodicity of the input signal, and generates the synthetic white noise signal by combining the white noise signal and the signal after undergoing the nonlinear processing together based on the maximum normalized autocorrelation value.

10. A frequency band expansion method of generating an output signal having a bandwidth wider than a bandwidth of an input signal, the method comprising:

calculating a weighting coefficient based on a frequency gradient of the input signal as a gradient of power of the input signal with respect to a frequency of the input signal;

generating a white noise signal;

generating a first white noise signal by performing filtering on the white noise signal;

generating a second white noise signal by regulating a phase characteristic of the white noise signal;

generating a third white noise signal by performing weighted addition on the first white noise signal and the second white noise signal by using the weighting coefficient;

generating the output signal in a procedure by adding together the input signal and a signal corresponding to the third white noise signal, and transmitting the output signal to an amplifier and a speaker that are operably connected together, wherein the phase characteristic of the second white noise signal is the same as the phase characteristic of the first white noise signal, wherein the procedure generates the output signal having the wider bandwidth than the bandwidth of the input signal without using a Fourier transform, thereby reducing an amount of computing power required to generate the output signal, and wherein transmitting the output signal to the amplifier and speaker facilitates controlling an output of sound from the speaker on a basis of the generated output signal.

11. A non-transitory computer-readable storage medium storing a frequency band expansion program for generating an output signal having a bandwidth wider than a bandwidth of an input signal, the program causing a computer to execute:

calculating a weighting coefficient based on a frequency gradient of the input signal as a gradient of power of the input signal with respect to a frequency of the input signal;

generating a white noise signal;

generating a first white noise signal by performing filtering on the white noise signal;

generating a second white noise signal by regulating a phase characteristic of the white noise signal, in which the phase characteristic of the first white noise signal and the phase characteristic of the second white noise signal are the same as each other;

generating a third white noise signal by performing weighted addition on the first white noise signal and the second white noise signal by using the weighting coefficient;

generating the output signal in a procedure by adding together the input signal and a signal corresponding to the third white noise signal, and transmitting the output signal to an amplifier and a speaker that are operably connected together, wherein the procedure generates the output signal having the wider bandwidth than the bandwidth of the input signal without using a Fourier transform, thereby reducing an amount of computing power required to generate the output signal, and wherein the program causes the computer to execute controlling an output of sound from the speaker on a basis of the generated output signal.

* * * * *